US007111840B2

(12) United States Patent
Miyamoto

(10) Patent No.: US 7,111,840 B2
(45) Date of Patent: Sep. 26, 2006

(54) SHEET FEEDING ROLLER WITH VARIABLE RADIUS, SHEET FEEDING APPARATUS AND IMAGE FORMING APPARATUS

(75) Inventor: Takayuki Miyamoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 187 days.

(21) Appl. No.: 10/277,035

(22) Filed: Oct. 22, 2002

(65) Prior Publication Data

US 2003/0080493 A1 May 1, 2003

(30) Foreign Application Priority Data

Oct. 29, 2001 (JP) ..... 2001-330669
May 30, 2002 (JP) ..... 2002-156998

(51) Int. Cl.
*B65H 3/06* (2006.01)

(52) U.S. Cl. ..... 271/119; 271/117; 271/120

(58) Field of Classification Search ..... 271/109, 271/37, 117, 118, 119, 120
See application file for complete search history.

(56) References Cited

U.S. PATENT DOCUMENTS

| | | | | |
|---|---|---|---|---|
| 3,572,691 | A * | 3/1971 | Heinricy | 271/23 |
| 3,649,003 | A * | 3/1972 | Muller et al. | 271/120 |
| 5,449,161 | A * | 9/1995 | Gysling | 271/119 |
| 5,519,475 | A | 5/1996 | Miyamoto et al. | 355/271 |
| 5,862,435 | A | 1/1999 | Suzumi et al. | 399/68 |
| 6,085,058 | A | 7/2000 | Goto et al. | 399/313 |
| 6,186,490 | B1 * | 2/2001 | Sugiura et al. | 271/10.09 |
| 6,477,348 | B1 | 11/2002 | Miyamoto et al. | 399/299 |
| 6,626,427 | B1 * | 9/2003 | Choi et al. | 271/119 |
| 6,634,636 | B1 * | 10/2003 | Graef et al. | 271/120 |

* cited by examiner

*Primary Examiner*—Patrick Mackey
(74) *Attorney, Agent, or Firm*—Fitzpatrick, Cella, Harper & Scinto

(57) ABSTRACT

The present invention relates to a sheet feeding roller for feeding a sheet by rotation in pressed contact with stacked sheets by an outer peripheral surface of the roller. A distance from a rotary center to the outer peripheral surface is changeable according to the state of feeding of the sheet.

12 Claims, 9 Drawing Sheets

SHEET FEEDING ROLLER WITH VARIABLE RADIUS, SHEET FEEDING APPARATUS AND IMAGE FORMING APPARATUS

BACKGROUND OF THE INVENTION

1. Field of the Invention

This invention relates to a sheet feeding roller, mounted to a sheet feeding section for feeding sheets for image forming apparatuses such as printers, photocopiers, and the like, for feeding sheets by rotating in pressed contact with stacked sheets and to a sheet feeding apparatus and an image forming apparatus having this roller.

2. Description of Related Art

Referring to FIG. 9, a sheet feeding roller for feeding such as original documents and recording sheets in a conventional image forming apparatus such as printer or photocopier is described. As shown in FIG. 9, in a sheet feeding roller 100, a housing 102 for supporting a rubber 101 serving as an elastic body is secured to a rotary shaft 103 to which drive is transmitted, and sheets are fed sheet by sheet according to rotation of the rotary shaft 103. The sheet feeding roller 100 is in a half moon shape having a cutout 104 at a part thereof, and at the home position while in waiting state, the cutout 104 faces to the sheets and does not contact with the sheets. An arc portion ensures an adequate length allowing one sheet to be picked up and delivered to the subsequent roller, not shown, disposed on a downstream side. Grooves and the like are formed on a surface of the sheet feeding roller 100, thereby devising the roller as to improve the friction force from the shape.

Sheets are stacked on a special feeding cassette 105. An intermediate plate 106 for placing the sheet bundle thereon and a spring 107 for urging the intermediate plate 106 toward the sheet feeding roller 100 are formed inside the feeding cassette 105. A separation pawl 108 is formed on a downstream side of the sheet feeding roller on the sheet feeding cassette 105, 100 in the sheet feeding direction, corresponding to the corner of the front end of the sheet placed on the intermediate plate 106, thereby separating sheets one by one by forming a loop to the sheets to some extent.

If the sheet feeding operation begins, the rotary shaft 103 starts rotating, thereby rotating the sheet feeding roller 100, and then, the roller 100 comes in pressed contact with the sheets in pushing down the sheet bundle at a portion where the sheet feeding roller 100 transits from the cutout 104 to the arc portion. The rubber 101 serving as an elastic body contacts to the topmost sheet of the sheets in applying a proper contacting pressure and feeds the sheet. At that time, a loop is gradually formed upon which the corner of the front end of the topmost sheet is made to urge the separation pawl 108, and finally the corner of the front end of the sheet disengages from the separation pawl 108 thereby separating solely the topmost sheet.

With such a sheet separation method in use of the separation pawl method, the contact pressure N applied between the sheet feeding roller 100 and the sheets is very important. If the contact pressure N is too weak, the sheets cannot overcome the opposition force from the separation pawl 108 when the sheets are urge against the separation pawl 108, so that slipping is made between the sheet feeding roller 100 and the sheets and that the sheets cannot be fed smoothly. If the contact pressure N is too strong, large frictional force may occur between the topmost sheet and the sheet just below the topmost sheet or sheets further below the topmost sheet, so that double or triple sheets may be fed instead of feeding of a single sheet.

To avoid such a problem, normally the spring 107 for lifting up the intermediate plate 106 is made with a proper load setting and a spring coefficient setting. More specifically, the weight of sheets changes according to the stacked number, and according to the stacked number, the contraction amount of the spring 107 also changes for lifting up the intermediate plate 106. Using this relation of both, the spring coefficient is set so as to make approximately constant the load exerted to the sheet feeding roller 100 and the sheets even where the stacked number of the sheets is changed.

With the structure according to the conventional art, if the kind of the sheets set to the sheet feeding cassette 105 is unchanged, the load exerted between the sheet feeding roller 100 and the sheet can be an optimum value as the theory described above, but in fact, the size and density of the stacked sheets may be diversified to many kinds. There is no spring to give constantly the optimum load to these various sheets, and the reality is that a spring having a proper value is selected in evaluating the whole balance with respect to the various sheets.

According to recent colorization of image forming apparatuses such as printers, it is a trend that users favor sheets having thicker thickness. On the other hand, from the reason to avoid environmental destructions, sheets having thinner thickness are also used more frequently. Thus, demands on the sheets allowed to be fed from the sheet feeding cassette 105 are made various, and it is difficult to correspond all the variety by solely optimizing the spring 107. That is, if the design targets at the thick paper, the spring load described above is set strongly, and therefore, doubly feeding failures (in which sheets are fed in a stacked manner) may occur in the case of thin paper although feeding failures (i.e., a phenomenon in which sheet feeding roller 100 slips on the sheet and is unable to feed out the sheet) may not occur. To the contrary, if the design targets at the thin paper, the spring load is set weakly, thereby raising a problem such that feeding failures may occur in the case of the thick paper even while doubly feeding failure may not occur.

It is an object to provide a sheet feeding roller automatically adjusting contact pressure exerted between the sheet feeding roller and sheets during feeding operation and being capable of feeding sheets properly and surely, and to provide a sheet feeding apparatus and an image forming apparatus having the above sheet feeding roller.

SUMMARY OF THE INVENTION

To solve the above problem, in representative structures of a sheet feeding roller, a sheet feeding apparatus, and an image forming apparatus, a sheet feeding roller for feeding sheets by rotation in pressed contact to stacked sheets with the outer peripheral surface has a feature that a distance from a rotary center to the outer peripheral surface can change according to the state of sheet feeding.

With the sheet feeding roller, the sheet feeding apparatus, and the image forming apparatus according to this invention, the distance from the rotary center to the outer peripheral surface of the sheet feeding roller is structured to change in accordance with state of the feeding, so that the contact pressure exerted between the sheet feeding roller and the sheets during sheet feeding is automatically adjusted with a very simple structure, thereby rendering the sheet feeding performance improved.

DESCRIPTION OF PREFERRED EMBODIMENTS

[First Embodiment]

Figure 1:
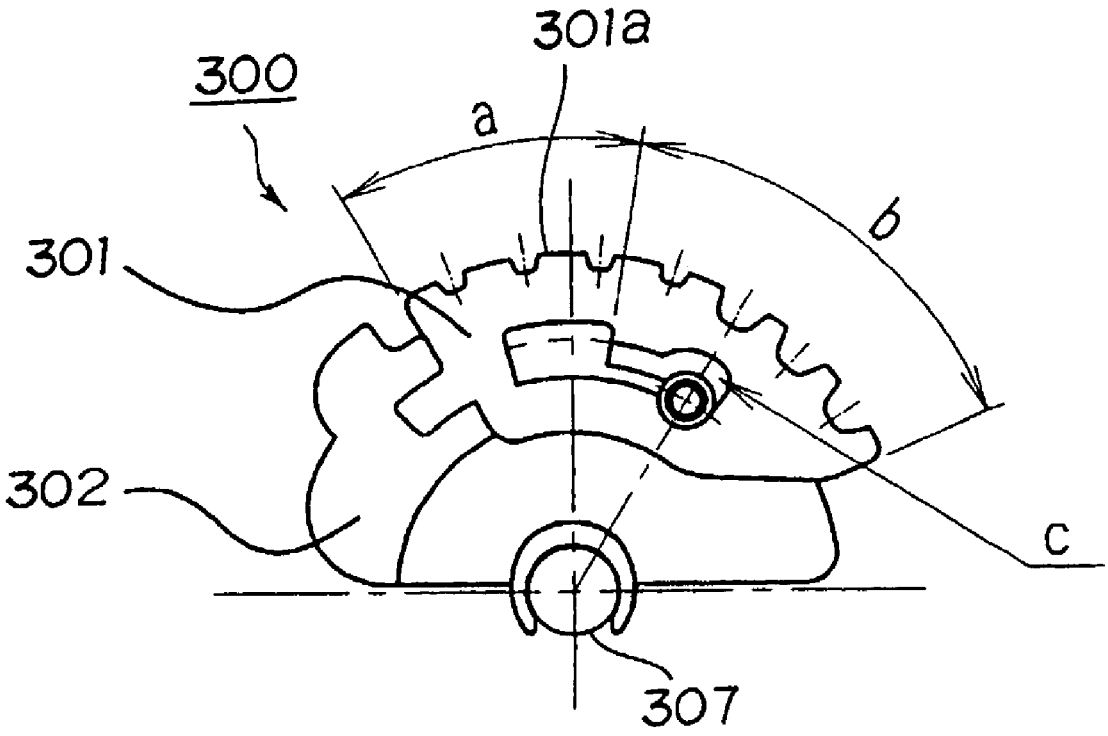
FIG. 1 is an illustration showing a structure of a sheet feeding roller according to the first embodiment.
Figure 2A:
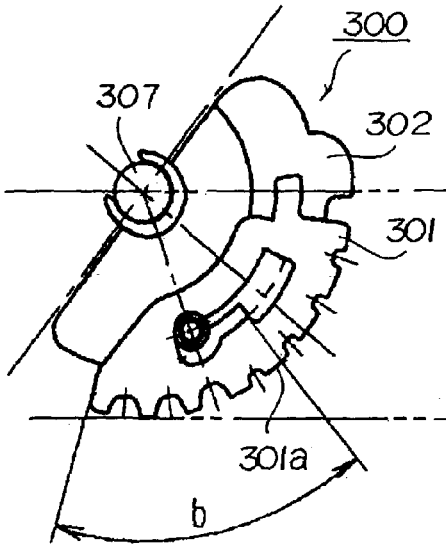
FIG. 2 is an illustration describing operation of the sheet feeding roller.
Figure 2B:
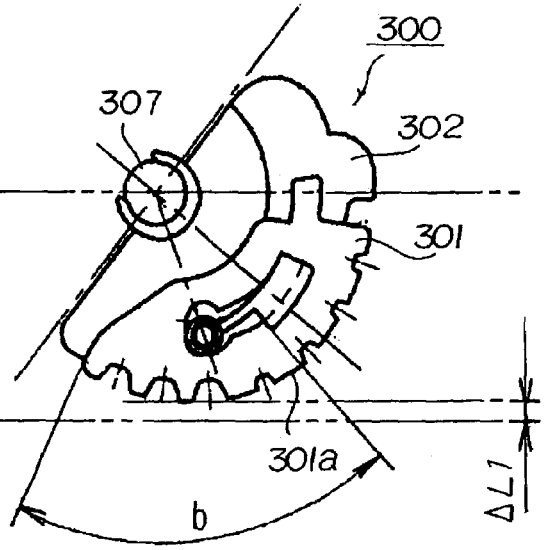
Figure 3A:
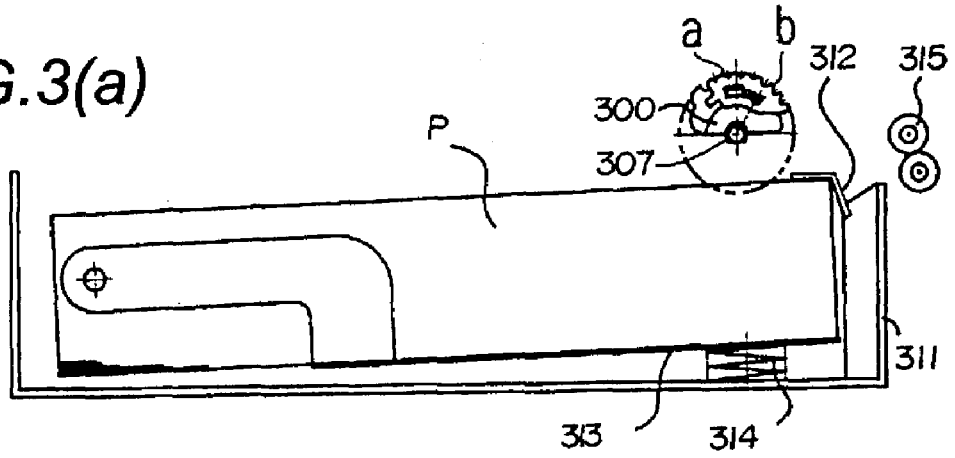
FIG. 3 is an illustration describing the feeding operation chronologically.
Figure 3B:
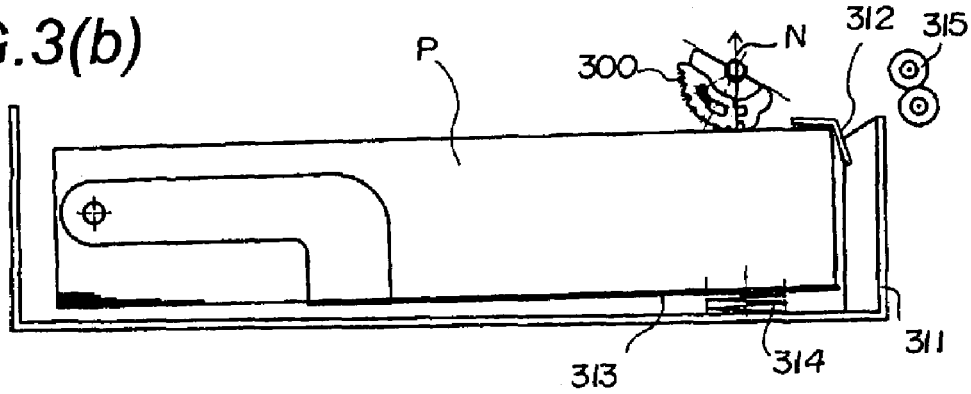
Figure 3C:
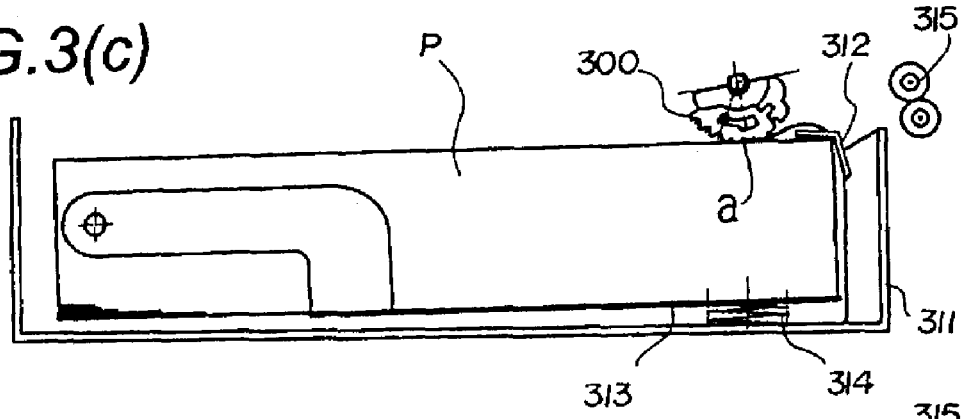
Figure 3D:
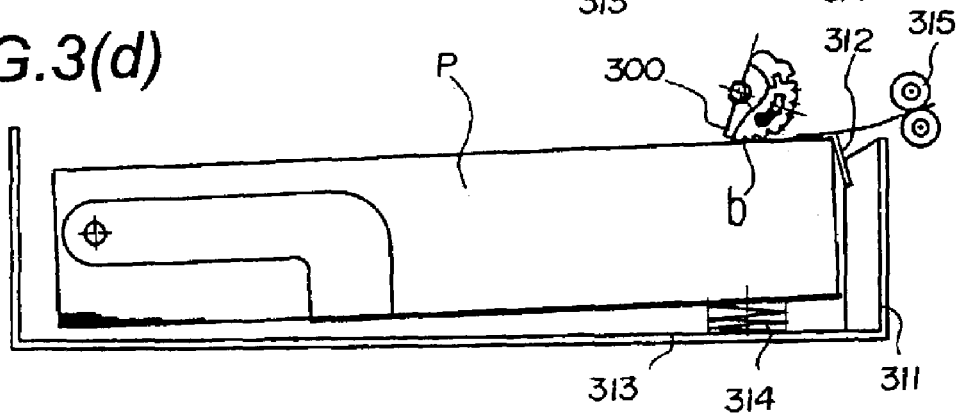

Referring to the drawings, a sheet feeding roller of the first embodiment according to the invention will be described. FIG. 1 is an illustration showing a structure of a sheet feeding roller according to the first embodiment. FIG. 2 is an illustration describing operation of the sheet feeding roller. FIG. 3 is an illustration describing the feeding operation chronologically.

As shown in FIG. 1, a sheet feeding roller 300 is structured to have a rubber member 301 serving as a frictional member with plural grooves (knurled grooves) formed on a surface of an outer peripheral surface 301*a* to which the sheet contacts, and a holding plate 302 serving as a holding member for holding the rubber member. The holding plate 302 is secured without any space in a radial direction in a range of the front side portion (a range of a in FIG. 1) of the rubber member 301 in a rotational direction of the sheet feeding roller 300 and is disposed with a gap c in the radial direction in a range of a rear side portion (a range of b in FIG. 1) in a rotational direction of the sheet feeding roller 300. That is, the rubber member 301 is structured so that, if force in the radial direction is exerted from the exterior to the rubber member 301, the rear side portion b is only transformed from the elasticity thereof. It is to be noted that the sheet feeding roller 300 is attached to a rotary shaft 307 to which drive force is transmitted from a motor or the like, not shown, and the rotary shaft 307 is fixedly secured to an apparatus housing.

Next, a structure of a sheet feeding cassette 311 is described using FIG. 3. An intermediate plate 313 is supported pivotally at the rear end side (left side end in FIG. 3) in the sheet feeding cassette 311. The intermediate plate 313 is urged upward by a spring 314 serving as an urging member. A separation pawl 312 is arranged at a corner of the front end of the sheets P stacked on the intermediate plate 313 as to be supported to a side limiting plate or cassette housing, not shown, and to move pivotally up and down in a prescribed range. The separation pawl 312 restricts the sheets by contacting the front end in the feeding direction and the upper side of the sheets. The upward movable range of the separation pawl 312 is limited to a position in FIG. 3(*a*), so that the position of the topmost face of the sheets P is constantly aligned in opposing to the urging force of the spring 314.

Referring to FIG. 3, next, the sheet feeding operation in use of the sheet feeding roller 300 according to this embodiment is described. FIG. 3(*a*) shows a waiting state in which the sheets P are set in the sheet feeding cassette 311. The separation pawl 312 is held at that time in a state contacting to the top face of the sheets P, and the spring 314 as the urging member is contracted by the weight of the sheets P stacked on the intermediate plate 313.

The sheet feeding roller 300 starts rotating by the drive system, not shown, and as shown in FIG. 3(*b*), if the roller 300 comes to contact to the topmost face of the sheets P at a position that the cutout transits to the arc portion in the sheet feeding roller 300, the spring 314 is contracted through the intermediate plate 313 according to pushing down of the sheets P. In this embodiment, the contact pressure around 1.96 N as total pressure is exerted between the sheet feeding roller 300. As shown in FIG. 3(*c*), if the sheet feeding roller 300 continues rotating further, the topmost sheet P is fed out by the front side (range a in FIG. 1) of the rubber member 301 of the sheet feeding roller 300, and a loop is formed at the comer of the front end upon which the front end of the sheet P contacts to the separation pawl 312.

As the front end corner of the sheet P disengages from the separation pawl 312 where the loop becomes larger, the topmost sheet is separated. After the front end of the sheet P disengages from the separation pawl 312 to nullify the opposing force made by the loop, the rear side portion (range b in FIG. 1) of the rubber member 301 of the sheet feeding roller 300 contacts, as shown in FIG. 3(*d*), the top surface of the sheet P to be fed, so that the rear side portion is elastically deformed by the urging force of the spring 314 to change the contour, thereby rendering shorter the distance from the shaft center of the rotary shaft 307 of the sheet feeding roller 300 to the outer peripheral surface 301*a*. This makes the spring 314 longer than the previous state, that is, the state given with the total pressure of 1.96N, and as a result, the contact pressure N is reduced. In this embodiment, the contact pressure N is reduced to around 1.37 N. The sheet P can be fed to the conveyance roller pair adequately even with lower conveying force where passing over the separation pawl 312. If it is constituted in a manner not like this invention, or if the sheet P is fed where the radius of the sheet feeding roller 300 is in an unchanged state, a constant pressure is continuously exerted even after the separation pawl 312 is disengaged, so that a subsequent sheet disposed below may be fed, and so that double feeding tends to occur.

With this embodiment, an elastic transformation of the rubber member 301 is utilized as a method to reduce the distance from the shaft center of the rotary shaft 307 to the outer peripheral surface 301*a* at the rear side b of the sheet feeding roller 300. This method provides the following advantages.

Referring to FIG. 2, the advantages are described. The contact pressure (feeding pressure) between the sheets P and the sheet feeding roller 300 normally changes according to the density of the stacked sheets (weight per unit area), and the contact pressure becomes low where the sheet density is high whereas the contact pressure becomes high where the sheet density is low. First of all, a situation that the density of loaded sheets is high (or the weight per unit area is heavy) is described. Where the density of the sheet P is high, the contact pressure N exerted to the sheet feeding roller 300 becomes lower due to the weight of the sheet P. In this situation, the contact pressure at the rear side portion b of the sheet feeding roller 300 is desirably not to be weakened. According to this structure, the sheet feeding roller 300 is transformed from the elasticity of the rubber member 301, so that the transformation amount of the rubber member 301 becomes smaller as shown in, for example, FIG. 2(*a*) if the force exerted thereto is small, and therefore, the used length of the spring 314 is hardly changed. More specifically, the contact pressure is reduced merely to around 1.86 N in this embodiment in a case of a sheet whose density (area density) is about 105 g/m$^2$.

On the other hand, in the case where the density of the sheet P is low (or the weight per unit area is light), the contact pressure N exerted to the sheet feeding roller 300 becomes higher. In this situation, the contact pressure at the rear side portion b of the sheet feeding roller 300 is desirably to be weakened. According to this structure, the sheet feeding roller 300 is transformed from the elasticity of the rubber member 301, so that the transformation amount of the rubber member 301 becomes larger as shown in, for example, FIG. 2(*b*) if the force exerted thereto is large, and therefore, the used length of the spring 314 is changed with a tendency to be extended by ΔL1 in comparison with the used length shown in FIG. 2(*a*), thereby automatically reducing the contact pressure N since the elasticity of the spring is in inverse proportion to the length. More specifically, the contact pressure is reduced to around 1.37 N in a case of a sheet whose density (area density) is about 60 g/m$^2$.

From the structure as described above, the sheet feeding roller 300 according to this embodiment can automatically adjust the contact pressure N in accordance with the density of the sheet P (the weight per unit area) and can obtain good feeding performance in avoiding sheet feeding failure and doubly feeding failure.

[Second Embodiment]

Figure 4A:
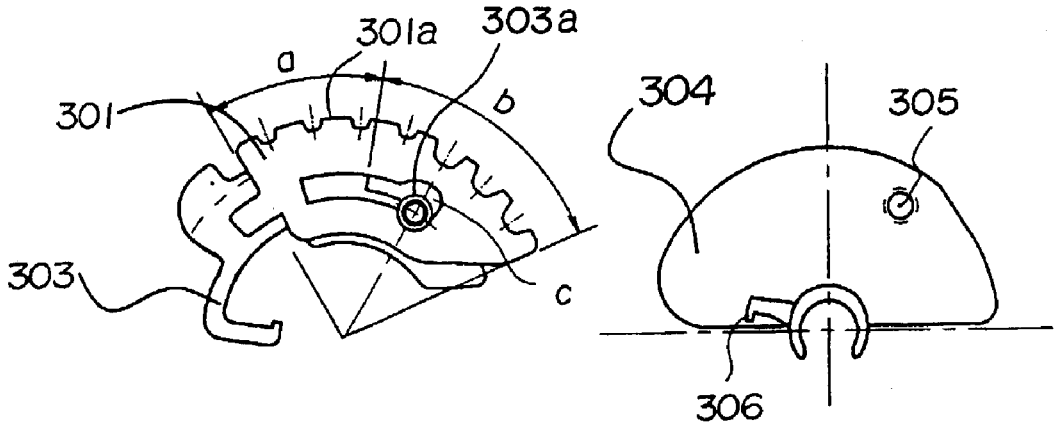
FIG. 4 is an illustration showing a structure of a sheet feeding roller according to the second embodiment.
Figure 4B:
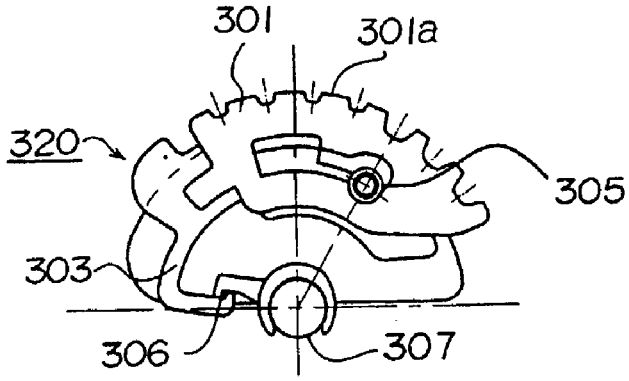
Figure 4C:
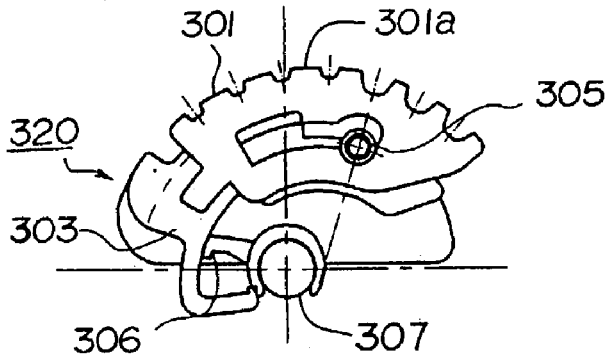
Figure 5A:
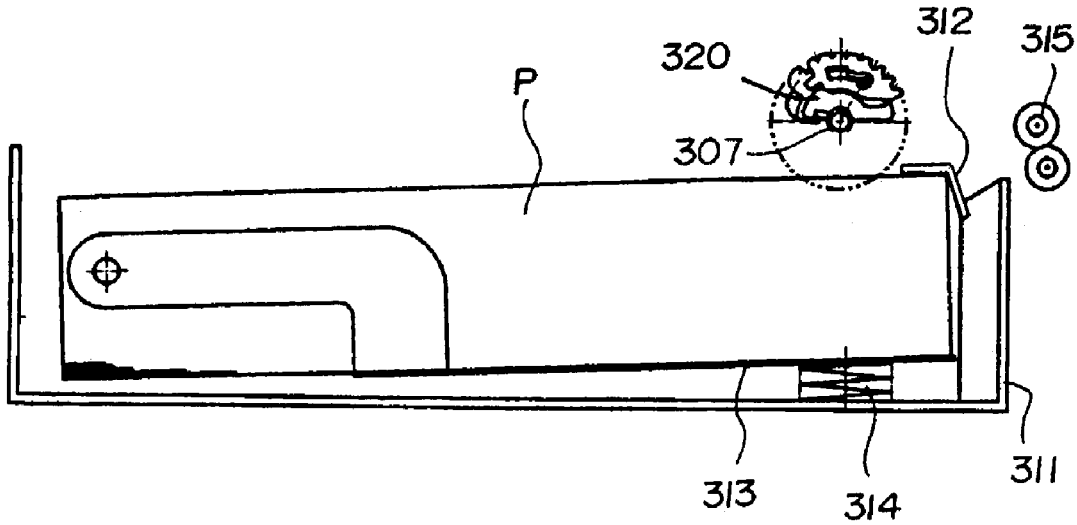
FIG. 5 is an illustration describing operation of the sheet feeding roller.
Figure 5B:
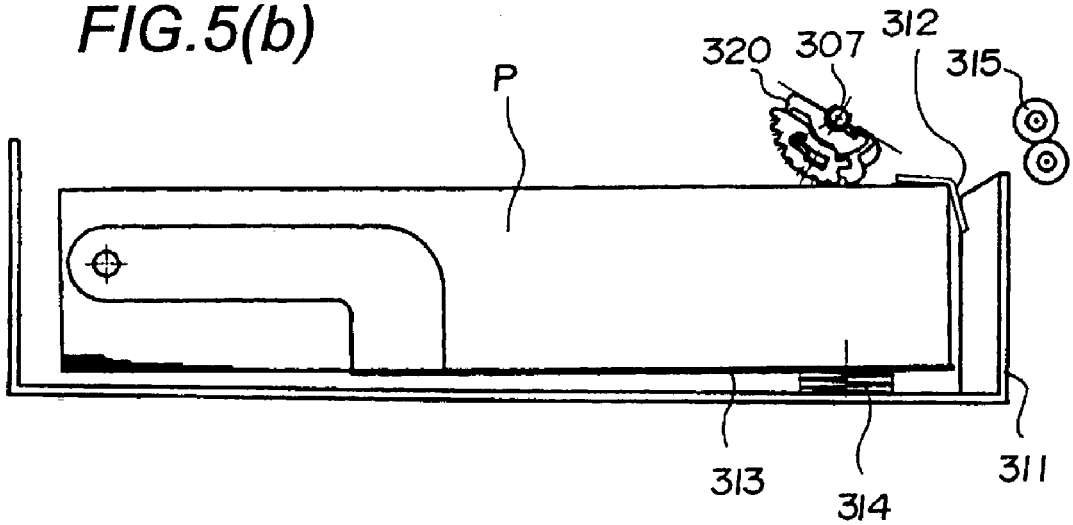
Figures 6A, 6B:
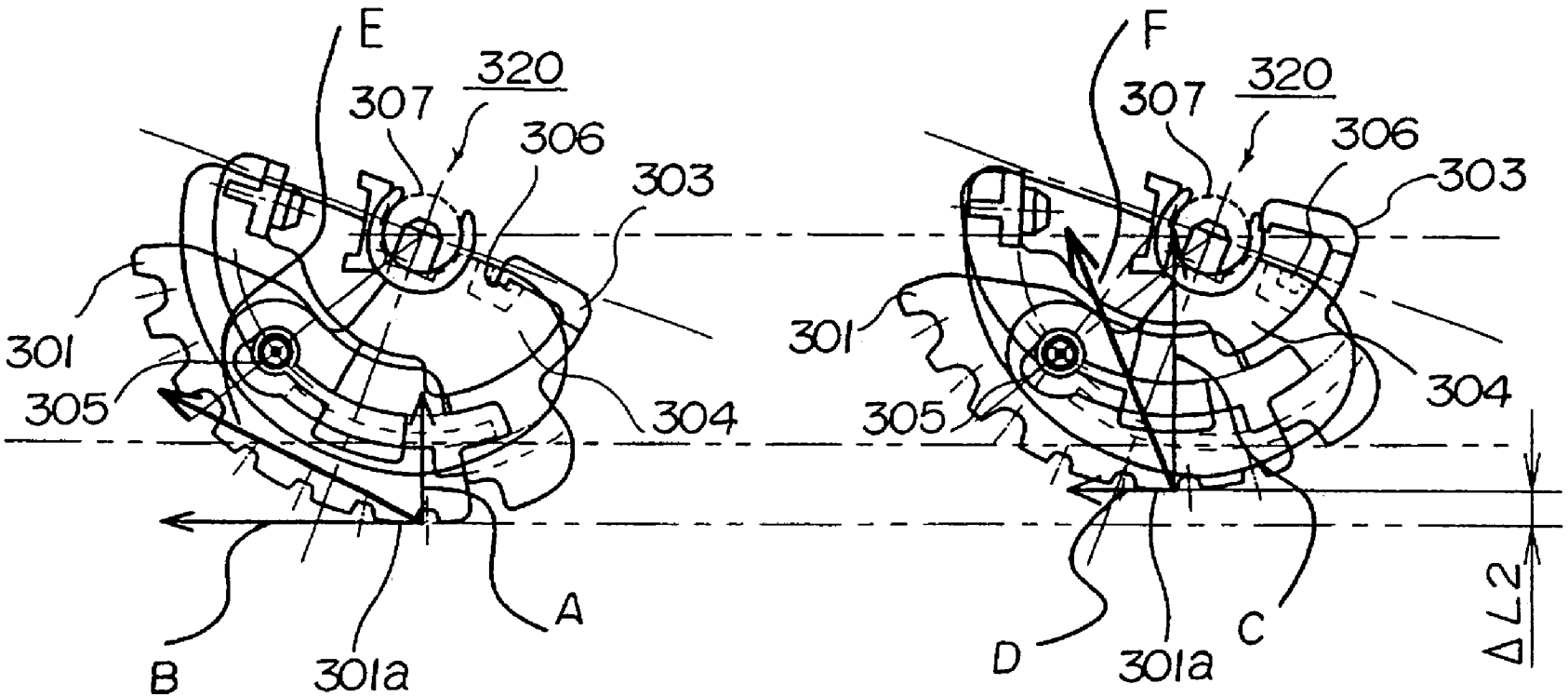
FIG. 6 is an illustration describing force exerted to the sheet feeding roller.

Referring to FIG. 4 to FIG. 6, a second embodiment of the sheet feeding roller according to this invention will be described. FIG. 4 is an illustration showing a structure of a sheet feeding roller according to the second embodiment; FIG. 5 is an illustration describing operation of the sheet feeding roller; FIG. 6 is an illustration describing force exerted to the sheet feeding roller; descriptions about portions already described in the first embodiment are omitted by assigning the same reference numbers.

As shown in FIG. 4(*a*), the sheet feeding roller 320 is constituted of a rubber member 301 serving as a frictional member with plural grooves formed on a surface of an outer peripheral surface 301*a* to which the sheet contacts, a holding plate 303 serving as a holding member for holding the rubber member, and a housing member 304 fixedly secured to a rotary shaft 307. The rubber member 301 and the holding plate 303 constitute the outer peripheral portion of this invention. The housing member 304 has a rotary center 305 for rotatably supporting the holding plate 303, and a stopper 306 for stopping the rotation of the holding plate 303. The holding plate 303 is, in the same manner as in the first embodiment, secured without any space in a radial direction in a range of the front side portion (a range of a in FIG. 4) of the rubber member 301 in a rotational direction of the sheet feeding roller 320 and is disposed with a gap c in the radial direction in a range of a rear side portion (a range of b in FIG. 4). That is, the rubber member 301 is structured so that, if force in the radial direction is exerted from the exterior to the rubber member 301, the rear side portion b is only transformed from the elasticity thereof.

As shown in FIG. 4(*b*), the holding plate 303 is pivotally supported to the housing member 304 by the rotary center 305 in fitting the rotary center 305 of the housing member 304 into a hole 303*a* of the holding plate 303, and the pivotal angle of the holding plate 303 is limited by contact of the stopper 306 to an inner peripheral surface of the holding plate 303. Accordingly, if pressure is exerted to the outer peripheral surface 301*a* of the sheet feeding roller 320, the holding plate 303 is as shown in FIG. 4(*c*) structured to move pivotally with respect to the housing member 304. Thus, one of features of the invention is that the distance from the shaft center of the rotary shaft 307 to the outer peripheral surface 301*a* of the rubber member 301 can be changed because the holding plate 303 moves pivotally between a position that the outer peripheral surface 301*a* of the rubber member 301 is located at the outermost side as shown in FIG. 4(*b*) and a position that the outer peripheral surface 301*a* of the rubber member 301 is located at the innermost side as shown in FIG. 4(*c*).

Next, referring to FIG. 5, the feeding operation in use of the sheet feeding roller 320 according to this embodiment is described. First, FIG. 5(*a*) shows a waiting state in which the sheets P are set to the sheet feeding cassette 311. The separation pawl 312 is, at that time, held as in a state placed on the sheets P, and the spring 314 is contracted by the weight of sheets P stacked on the intermediate plate 313. The rotary shaft 307 rotates to begin the rotation of the sheet feeding roller 320 and to render the roller contact to the sheets P as shown in FIG. 5(*b*), and thereby, the spring 314 is further contracted by pushing down the sheets P together with the intermediate plate 313.

Now, how the state of the sheet feeding roller 320 changes between the case where the density (weight per unit area) of the sheet P set to the sheet feeding cassette 311 is high and the case where the density is low.

As described above, the contact pressure (feeding pressure) between the sheets P and the sheet feeding roller 320 normally changes according to the density (weight per unit area of the stacked sheets, and the contact pressure becomes low where the sheet density is high whereas the contact pressure becomes high where the sheet density is low. First of all, when the sheet feeding roller 320 begins rotating to contact to the sheets P, and where the density of the sheets P is high, the contact pressure becomes low due to its weight and is shown by Vector A in FIG. 6(*a*). When feeding of the sheets P is started, an inverse force (resistance of conveyance) from the separation pawl 312 becomes larger because the sheet having a higher density normally has a larger rigidity, and this force is depicted by Vector B in FIG. 6(*a*). The integrated force of two Vectors A, B makes Vector E, and because the direction of Vector E faces more outwardly than the position of the rotary center 305, moment is produced in which the holding plate 303 is to be rotated in a clockwise direction with respect to the rotary center 305. The integrated force of Vector E urges the holding plate 303 in the clockwise direction, so that the sheet feeding roller 320 as shown in FIG. 6(*a*) enters in a state that the distance from the shaft center of the rotary shaft 307 to the outer peripheral surface 301*a* of the rubber member 301 is long by correlatively forward movement of the rubber member 310.

On the other hand, if the density of the sheets P is low, the contact pressure becomes high when the sheets P is started to be fed. This is depicted by Vector C shown in FIG. 6(*b*). When the feeding of the sheets P begins, the inverse force (resistance of conveyance) from the separation pawl 312 becomes small because the sheet has a lower rigidity as the density is lower. This force is illustrated as Vector D shown in FIG. 6(*b*). The integrated force of Vectors C, D therefore constitute Vector F, and because the direction of Vector F faces more inwardly than the position of the rotary center 305, moment is produced in which the holding plate 303 is to be rotated in a counterclockwise direction with respect to the rotary center 305. The integrated force of Vector F urges the holding plate 303 in the counterclockwise direction, so that the sheet feeding roller 320 as shown in FIG. 6(*b*) enters in a state that the distance from the shaft center of the rotary shaft 307 to the outer peripheral surface 301*a* of the rubber member 301 is short.

That is, the rotary shaft 305 is disposed in a range of the integrated force of the contact pressure and the conveyance resistance; the state of the sheet feeding roller 320 is switched to two steps according to the direction of the integrated force with respect to the rotary shaft 305; the direction of the integrated force changes according to the sheet density and the sheet rigidity. The difference between the two states of the sheet feeding roller 320 brings, as a result, changes in the distance between the shaft center and the outer peripheral surface 301*a* of the sheet feeding roller 320, and the contact pressure is therefore automatically changed where the used length of the spring 314 is changed by portion of ΔL2 shown in FIG. 6(*b*). That is, in the case that the sheet has a high density, the distance between the outer peripheral surface 301*a* and the shaft center of the rotary shaft 307 becomes longer as shown in FIG. 6(*a*), thereby rendering the contact pressure relatively strong and preventing sheet feeding failures from occurring. In the case that the sheet has a low density, the distance between the outer peripheral surface 301*a* and the shaft center of the rotary shaft 307 becomes shorter as shown in FIG. 6(*b*), thereby rendering the contact pressure relatively weak and preventing doubly feeding failures from occurring. As one example in this embodiment, where the density (area density) is 105 g/m$^2$, the contact pressure is 1.96 N, and where the density (area density) is 60 g/m$^2$, the contact pressure becomes 1.57 N.

It is to be noted that the rear side portion b of the sheet feeding roller 320 operates in the same manner as the first embodiment, and such descriptions are omitted here to avoid duplicated explanation.

[Third Embodiment]

Figure 7A:
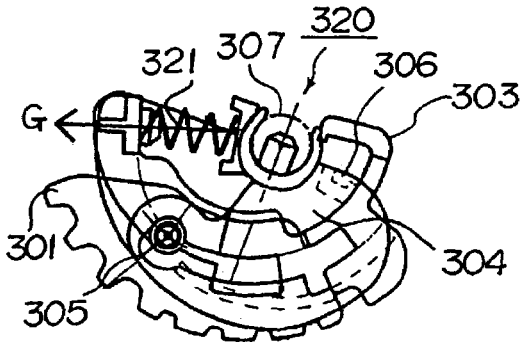
FIG. 7 is an illustration describing a structure of a sheet feeding roller and exerted force according the third embodiment.
Figure 7B:
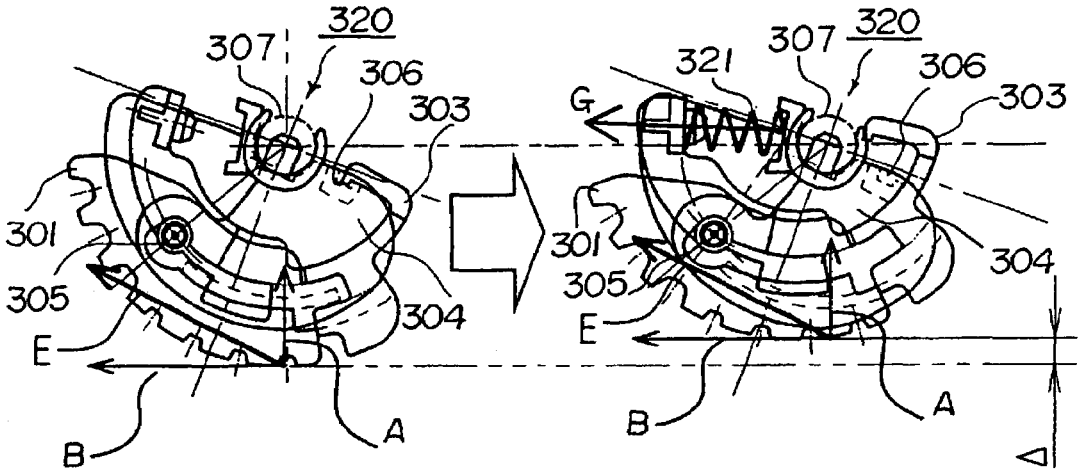

Referring to FIG. 7, a third embodiment of a sheet feeding roller according to the invention will be described. FIG. 7 is an illustration describing a structure of a sheet feeding roller and exerted force according the third embodiment; descriptions about portions already described in the first or second embodiment are omitted by assigning the same reference numbers. This structure has a feature incorporating with a spring for adjustment as an elastic member in the sheet feeding roller described in the second embodiment so as to finely adjust the switching between the state that the distance between the outer peripheral surface 301*a* of the sheet feeding roller 320 and the shaft center of the rotary shaft 307 becomes longer and the state that the distance becomes shorter. This roller has the same structures and functions as those of the sheet feeding roller of the second embodiment.

As shown in FIG. 7(*a*), with this structure, the adjusting spring 321 (contraction spring) is disposed between the holding plate 303 and the housing member 304. The sheet feeding roller 320 is given by this spring 321 force G in a direction to reduce the distance between the outer peripheral surface 301*a* and the shaft center of the rotary shaft 307, or namely in a direction to keep the state shown in FIG. 7(*a*).

Accordingly, as already described in the second embodiment, though the integrated force (Vector E or F in FIG. 6) is determined by the contact pressure of the sheet P (Vector A or C in FIG. 6) and the inverse force from the separation pawl (Vector B or D in FIG. 6), the amount of the contact pressure when the distance between the outer peripheral surface 301*a* of the sheet feeding roller 320 and the rotary center of the rotary shaft 307 is switched can be adjusted by changing the elastic force of the adjusting spring 321 as described above. That is, the contact pressure when the distance between the outer peripheral surface 301*a* of the sheet feeding roller 320 and the rotary center of the rotary shaft 307 is switched can be set freely.

That is, installation of this adjusting spring 321 enables feeding to be optimized in accordance with the structure of the sheet feeding apparatus to which this structure applies (i.e., load amount of the spring 314 or arrangement of the sheet feeding roller 320).

Next, referring to FIG. 7, an example when a specific load is determined for the adjusting spring 321 in this embodiment is shown. The following explanation is that evaluation of sheet feeding performance in this structure is made after specific settings are set such as the load amount of the spring 314, arrangement of the sheet feeding roller 320, etc., in the sheet feeding apparatus.

First, while the adjusting spring 321 is not formed, it is supposed that the sheets having a density not less than X are fed while the sheet feeding roller 320 is in a state having a large outer diameter (see, FIG. 6(*a*)) and that the sheets having a density less than X are fed while the sheet feeding roller 320 is in a state having a small outer diameter (see, FIG. 6(*b*)). It is also supposed that the paper having the density of X plus alpha is turned out to provide good performance when fed in the state that the sheet feeding roller 320 is in a small outer diameter in a view to the feeding performance.

With such a case, the adjusting spring 321 described above is installed, and the load of the adjusting spring 321 is set to a proper amount (e.g., 0.3 N). As shown in FIG. 7(*b*), where such an adjusting spring is not arranged, the sheet feeding roller 320 performs feeding work for the sheets having density of X plus alpha with the state of the small outer diameter, which otherwise performs feeding work with the state of the large outer diameter, due to backward movement of the housing member 304 by the force G of the adjusting spring 321.

Thus, the integrated force E is adjustable by changing properly the load of the adjusting spring 321, thereby enabling the feeding mechanism to be further optimized and providing good feeding performance. Using the adjusting spring 321 as in this embodiment renders the rubber member 301 take the same position and state with respect to the housing member 304 when the sheet feeding roller 320 contacts to the sheets P at the beginning of the feeding operation, so that stable feeding can be performed. Particularly, as in this embodiment, where the sheet feeding roller 320 contacts to the sheets P from the state that the distance between the outer peripheral surface 301*a* and the shaft center of the rotary shaft 307 is short, the rubber member 301 rotates with respect to the housing member in a direction such that the contact pressure gradually becomes higher according to the density of the sheets P to render smooth the change of the contact pressure, so that the further stable feeding can be performed.

It is to be noted that in this embodiment, exemplified is a case in which a contraction spring is used and force in a direction as to keep the small outer diameter state (see, FIG.

6(*b*)) is applied, but the same result is obtainable when force in a direction holding the state of the large outer diameter (state shown in FIG. 6(*a*)) is applied where an extending spring is used, or where the attaching position of the spring is changed.

Figure 8:
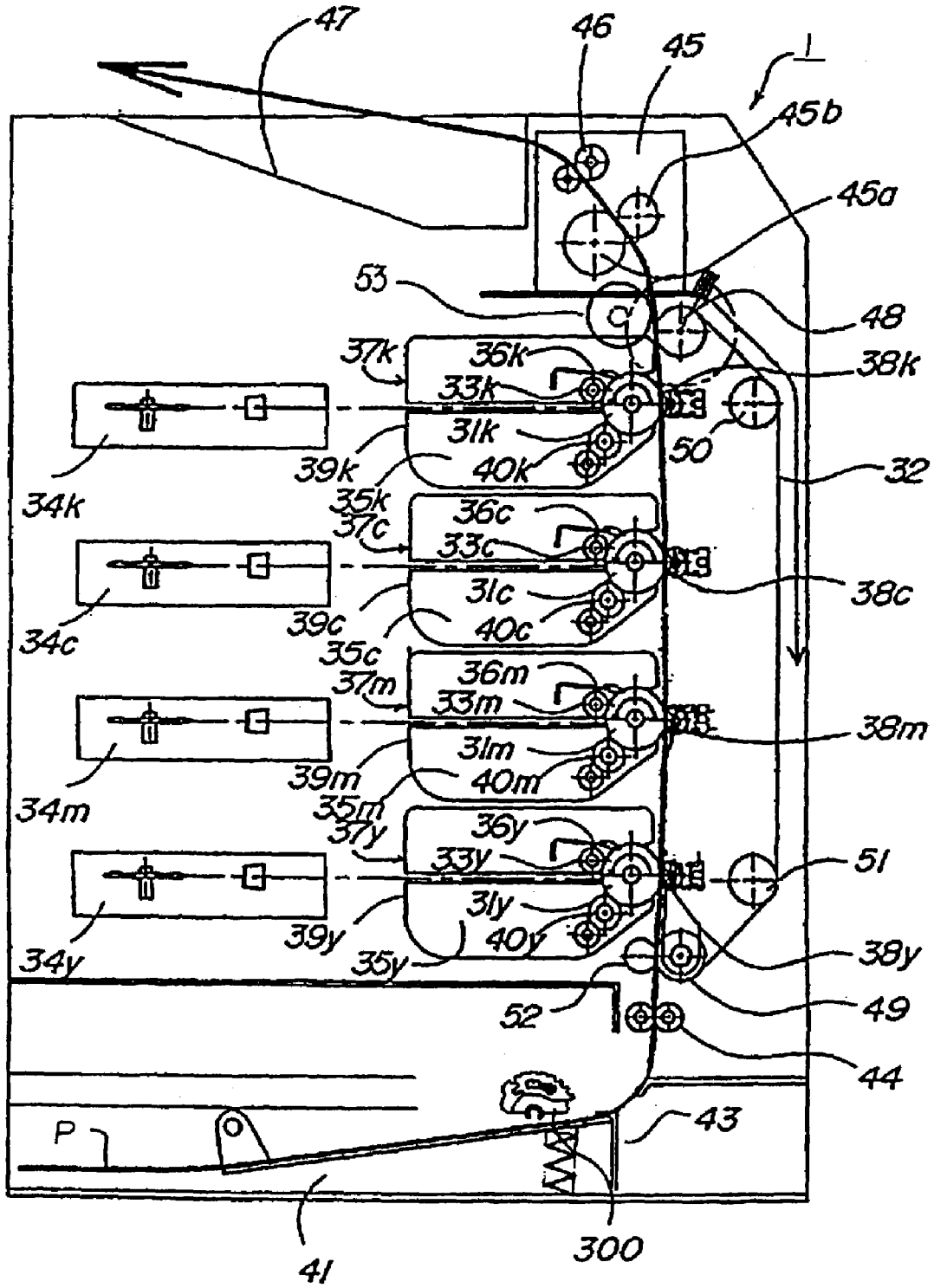
FIG. 8 is a whole structural view showing an image forming apparatus according to the fourth embodiment.
Figure 9:
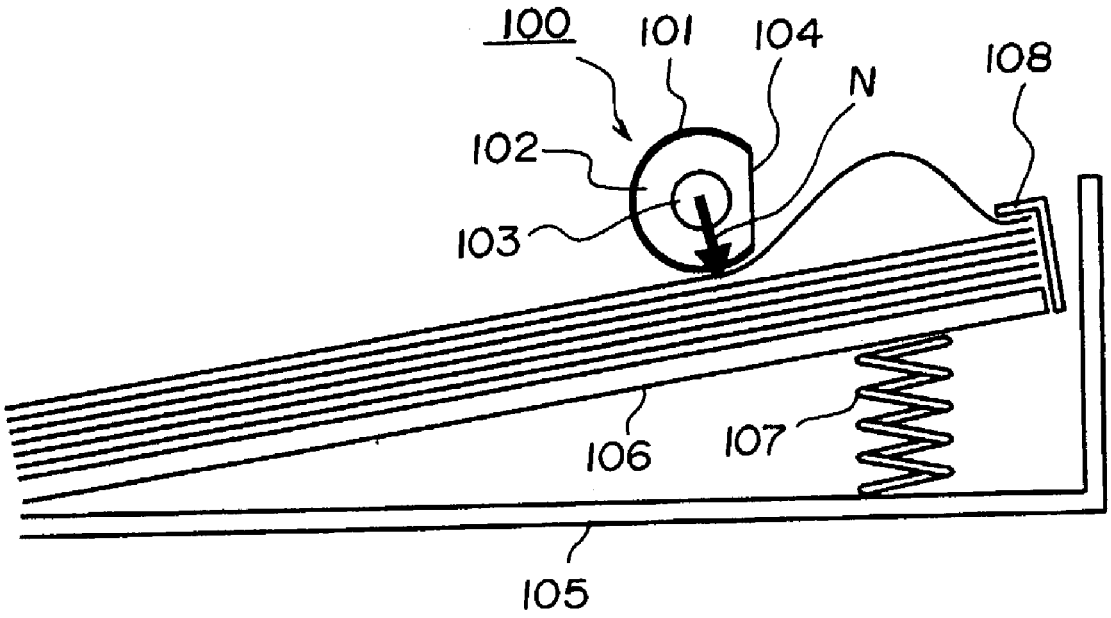
FIG. 9 is an illustration describing a conventional sheet feeding roller in an image forming apparatus.

Shown in FIG. 8 is a color laser printer as an image forming apparatus; the sheet feeding roller according to the invention is applied to the sheet feeding apparatus. Descriptions about portions already described in the above embodiments are omitted by assigning the same reference numbers The color image forming apparatus 1 shown in FIG. 8 has image forming means arranged parallel in a line extending vertically and has four electrophotographic photosensitive drums 31*y*, 31*m*, 31*c*, 31*k* in yellow, magenta, cyan, and black serving as image carriers (hereinafter called simply to as photosensitive drum). A transfer material conveying belt 32 serving as a transfer material carrier for carrying the sheets P by attracting the sheets through electrostatic attraction is disposed in facing to each photosensitive drum 31. The respective photosensitive drums 31 are disposed in a manner that the two photosensitive drums 31*m*, 31*c* located inside are projected toward the transfer material conveying belt 32 by about 1 mm with respect to the photosensitive drums 31*y*, 31*k* for yellow and black located upper and lower ends, and the motor 53 drives to rotate the drums in the counterclockwise direction.

Disposed around the respective photosensitive drums 31 are chargers 33*y*, 33*m*, 33*c*, 33*k* (hereinafter called simply to as chargers 33) serving as charging means for charging uniformly the surface of the photosensitive drum 31, and exposing means 34*y*, 34*m*, 34*c*, 34*k* (hereinafter called simply to as exposing means 34) for forming electrostatic latent image by radiation of laser beam based on the image information on the surface of the photosensitive drums 31 charged uniformly by the chargers 33.

Further more disposed are developing means 35*y*, 35*m*, 35*c*, 35*k* (hereinafter called simply to as developing means 35) for visualizing images as toner images by clinging toner of each color on a surface of the photosensitive drum 31 on which electrostatic latent image is formed, and cleaning means 36*y*, 36*m*, 36*c*, 36*k* (hereinafter called simply to as cleaning means 36) for removing toners remaining on the surface of the photosensitive drum 31 after the transfer is made. The photosensitive drums 31, the chargers 33, the developing means 35, and the cleaning means 36 are constituted as process cartridges 37*y*, 37*m*, 37*c*, 37*k* (hereinafter called simply to as process cartridge 37) formed in cartridges as a united body, which are detachably attached to the apparatus body.

Transfer rollers 38*y*, 38*m*, 38*c*, 38*k* (hereinafter called simply to as transfer roller 38) serving as transfer means for transferring toner images formed on the surface of the photosensitive drum 31 to the sheet P carried by the transfer material conveying belt 32 are disposed at positions facing to the photosensitive drums 31.

Each photosensitive drum 31 serving as an image carrier is formed of a cylinder made of aluminum having a diameter of 30 mm on the outer peripheral surface of which an organic photoconductive layer (OPC) is coated. The photosensitive drum 31 is rotatably supported by flanges at opposite ends thereof, and is rotatably driven in the counterclockwise direction by transmitting drive power from the drive motor, not shown, to one end thereof. The charger 33 is a conductive roller formed in a roller shape, and is for charging uniformly the surface of the photosensitive drum 31 by contacting this roller to the surface of the photosensitive drum 31 as well as by applying a charging bias voltage from a bias power source, not shown. The exposing means 34 has a polygon mirror to which image light is radiated in response to image signals from a laser diode, not shown.

The developing means 35 include, e.g., toner containers 39*y*, 39*m*, 39*c*, 39*k* (hereinafter called simple to as toner containers 39) for containing toner in yellow, magenta, cyan, and black, respectively, and developing rollers 40*y*, 40*m*, 40*c*, 40*k* (hereinafter called simple to as developing rollers 40) disposed in the vicinity of the surface of the photosensitive drum 31 and driven to rotate by a drive section, not shown, for rendering development by application of a developing bias voltage from a developing bias power source, not shown. The toner containers 39 contain the respective toners in yellow, magenta, cyan, black in the order from the upstream side in the conveyance direction of the sheets P.

The transfer roller 38 disposed inside the transfer material conveying belt 32 faces one of the four photosensitive drums 31 and contacts with the transfer material conveying belt 32. Those transfer rollers 38 are connected to a transfer bias power source, not shown. Positive charges from the transfer roller 38 are applied to the sheets P via the transfer material conveying belt 32, and by the electric field thus formed, color images are created from serial transfers of toner images in the respective colors having negative charges on the surface of the photosensitive drums 31 to the sheets P in contact with the photosensitive drums 31.

The sheets P contained in the sheet feeding cassette 41 provided at a lower portion of the apparatus body 1 reach a register roller pair 44 upon separation and feeding by the sheet feeding roller 300 described in the first embodiment or the sheet feeding roller 320 described in the second and third embodiments, and the separation pawl 43 provided on a downstream side of the sheet feeding roller 300 or the sheet feeding roller 320. Use of the sheet feeding roller 300 described in the first embodiment or the sheet feeding roller 320 described in the second and third embodiments enables the color printer to ensure excellent feeding property. It is to be noted that the specific structure of the sheet feeding roller section is the same as those described in the first to third embodiments, and therefore, the description is omitted in this embodiment.

The sheets P fed at a prescribed timing by the register roller pair 44 for measuring the timing between the sheets P and the images are conveyed to the transfer position between the photosensitive drum 31 as the image forming means and the transfer roller 38 while in the state that carried by the transfer material conveying belt 32 upon electrostatic attraction. After color images are recorded as transferred with toner images formed on the surfaces of the respective photosensitive drums 31, the toner images are fixed upon heat and pressure treatment when the sheet passes through a fixing means 45 having a heating roller 45*a* rotatably driving, and a pressure roller 45*b* driven to rotate in contact with the roller 45*a*. The sheets P are further delivered on a delivery tray 47 formed on a top of the apparatus body 1 by a delivery roller pair 46.

Now, an additional description of the structure using the transfer material conveying belt 32 is as follows. The transfer material conveying belt 32 is tensioned and supported by four rollers: a drive roller 48 and a driven roller 49 for tensioning a conveying surface of the transfer material as of two axial means, another driven roller 50 positioned immediately on a downstream side of the drive roller 48, and a tension roller 51 providing a tension to the transfer material conveying belt 32, and is arranged as to face to all the photosensitive drums 31.

The transfer material conveying belt 32 is made of an endless film shaped member having a volume resistivity of $10^{10}$ to $10^{14}$ Ωcm and a thickness of 100 to 150 micron meters. The volume resistivity is a value normalized with the thickness of the transfer material conveying belt 32 based on a measured value obtained through application of 100 Volt with a high resistance meter made by Advantest Corp. using a measuring prove in compliance with K6911 of the JIS.

The transfer material conveying belt 32 attracts with electrostatic charges the sheets P to the outer peripheral surface facing to the photosensitive drum 31 and so moves by means of the drive roller 48 in a circulating manner as to render the sheets P contact to the photosensitive drum 31. This conveys the sheet P to the transfer position by the transfer material conveying belt 32, thereby transferring toner images on the surface of the photosensitive drum 31.

An attracting roller 52 is disposed at a position facing to the driven roller 49 on the most upstream side in the transfer material conveying direction of the transfer material conveying belt 32 for sandwiching the sheet P in cooperation with the transfer material conveying belt 32 and for attracting the sheet P with electrostatic charges to the transfer material conveying belt. In conveyance of the sheet P, electric field is formed, by application of a bias voltage to the attracting roller 52, between the attracting roller 52 and the driven roller 49 grounded and opposed to the attracting roller 52 via the transfer material conveying belt 32, and dielectric polarization is generated between the transfer material conveying belt 32 and the sheet P, thereby producing electrostatic attracting force at both. This makes the sheets P stably conveyed at the transfer material conveying belt 32.

The above embodiments according to the invention are thus described, but this invention is not limited to those structures, and although in these embodiments exemplified is an example in which the separation pawl operates as for a sheet separation method, this invention is for preventing sheet feeding failure or doubly feeding failure from occurring by changing the contact pressure between the sheets and the sheet feeding roller according to the density of the sheets, so that this invention is applicable to some sheet feeding apparatuses having other separation methods, such as a slope separation method separating the sheets by urging the sheets to a slope, a separation pad method separating sheets with a separation pad or pads in pressed contact with the sheet feeding roller, and a retarding roller method using a reverse roller, etc.

The rubber member is exemplified as a specific example of the frictional member in the above description, but the frictional member can be made of a member having a prescribed frictional coefficient with respect to the surface of the sheets P to be fed, and other material such as elastomer resins and the like can be selected widely.

What is claimed is:

1. A sheet feeding apparatus comprising:

a plate on which sheets are stacked;

a sheet feeding roller which feeds out the sheet from the plate, wherein said sheet feeding roller comprises a frictional member having an elasticity in contact with the sheet and a holding member disposed at a rotary shaft for holding fixedly a front side portion of the frictional member in the rotational direction and holding a rear side portion of the friction member in the rotational direction to be elastically transformed; and a spring which provides a contact pressure between the sheet stacked on the plate and the sheet feeding roller;

wherein said sheet feeding roller feeds a sheet by rotation in pressed contact with stacked sheets on said plate by an outer peripheral surface of the frictional member, and at first the sheet stacked on the plate is fed by said fixed front side portion of the frictional member of said sheet feeding roller and subsequently the sheet is fed by said transformable rear side portion of the frictional member wherein in the case of feeding a sheet of high density, a distance from a rotary center of the sheet feeding roller to an outer peripheral surface of a rear side portion of the frictional member is made smaller so that the contact pressure is large, and in the case of feeding a sheet of low density, a distance from the rotary center of the sheet feeding roller to the outer peripheral surface of the rear side portion of the frictional member is made larger so that the contact pressure is small.

2. The sheet feeding apparatus according to claim 1, wherein the distance from the rotary center to the outer peripheral surface is changed by elastic transformation of the frictional member according to a contact pressure to the sheet.

3. The sheet feeding apparatus according to claim 1, wherein the holding member secures fixedly the portion of the frictional member without any space in a radial direction and secures the other portion with space in the radial direction to hold the other portion to be elastically transformed.

4. A sheet feeding apparatus comprising:

a plate on which sheets are stacked;

a sheet feeding roller which feeds out the sheet stacked on the plate by rotation in pressed contact with stacked sheets by an outer peripheral surface; and a spring which provides a contact pressure between the sheet stacked on the plate and the sheet feeding roller;

wherein said sheet feeding roller comprises:

a frictional member having an elasticity in contact with the sheet, and a housing member secured to a rotary shaft which is holding fixedly a front side portion of the frictional member in the rotational direction and holding a rear side portion of the frictional member to be pivotally moved as to change the distance from a rotary center to an outer peripheral surface of the rear side portion of the frictional member, wherein at first the sheet stacked on the plate is fed by said fixed front side portion of the frictional member and subsequently the sheet is fed by said movable rear side portion of the frictional member, and in the case of feeding a sheet of high density, a distance from the rotary center of a rotary shaft of the sheet feeding roller to an outer peripheral surface of a rear side portion of the frictional member is made smaller so that the contact pressure is large, and in the case of feeding a sheet of low density, a distance from the rotary center of the rotary shaft of the sheet feeding roller to the outer peripheral surface of the rear side portion of the frictional member is made larger so that the contact pressure is small.

5. The sheet feeding apparatus according to claim 4, wherein the distance from the rotary center to the outer peripheral surface is changeable by elastic transformation of the rear side portion of the frictional member according to the contact pressure to the sheet.

6. The sheet feeding apparatus according to any one of claims 1 and 4, wherein the distance from the rotary center to the outer peripheral surface in the case that the sheet stacked on the plate has a high density is longer than the distance in the case that the sheet has a low density, thereby the contact pressure in the case that the sheet has a high density is stronger than the contact pressure in the case that the sheet has a low density.

7. A sheet feeding apparatus comprising:

a plate on which sheets are stacked;

a sheet feeding roller which feeds out the sheet stacked on the plate by rotation in pressed contact with stacked sheets by an outer peripheral surface of the roller; and a spring which provides a contact pressure between the sheet stacked on the plate and the sheet feeding roller;

wherein said sheet feeding roller comprises a housing member fixedly secured to a rotary shaft to which drive force is transmitted, and a holding plate, to which a rubber member is attached having an outer peripheral surface in contact with the sheet, supported pivotally around a pivotal center to the housing member said rubber member having a fixed front side portion and a transformable rear side portion, wherein the distance from the rotary center to the outer peripheral surface is changeable by change of a pivotal direction of the holding plate according to that the direction of integrated force of contact pressure with the sheet exerted to the rubber member and conveyance resistance from the sheet orients to either the front side or rear side of the pivotal center with respect to the sheet feeding direction in association with the rigidity of the sheet.

8. The sheet feeding r apparatus according to claim 7, wherein the distance from the rotary shaft to the outer peripheral surface is set to be long when the direction of integrated force of contact pressure with the sheet exerted to the rubber member and conveyance resistance from the sheet orients the front side of the pivotal center with respect to the sheet feeding direction, and wherein the distance from the rotary shaft to the outer peripheral surface is set to be short when the integrated force orients the rear side of the pivotal center.

9. The sheet feeding apparatus according to claim 8, wherein an adjusting spring is arranged between the housing member and the holding plate to urge the holding plate in a direction to reduce the distance from the rotary shaft to the outer peripheral surface.

10. The sheet feeding apparatus according to claim 8, wherein the rubber member is fixedly secured to the holding plate at a front side in the sheet feeding direction and is not immobilized at a rear side, and wherein the rear side can be transformed elastically according to the contact pressure to the sheet.

11. The sheet feeding apparatus according to any one of claims 1, 2, 3, 4, 5 and 7 to 10, further comprising a separation pawl disposed on a downstream side in a feeding direction of the sheet feeding roller for separating the sheets fed out by the sheet feeding roller.

12. An image forming apparatus comprising:

an image forming means; and a sheet feeding apparatus as set forth in any of claims 1, 2, 3, 4, 5 and 7 to 10 for feeding out the sheet stacked by the plate to feed the sheet to the image forming means.

* * * * *

UNITED STATES PATENT AND TRADEMARK OFFICE

CERTIFICATE OF CORRECTION

PATENT NO. : 7,111,840 B2
APPLICATION NO. : 10/277035
DATED : September 26, 2006
INVENTOR(S) : Takayuki Miyamoto It is certified that error appears in the above-identified patent and that said Letters Patent is hereby corrected as shown below:

COLUMN 1:
Line 63, “urge” should read --urged--.

COLUMN 2:
Line 63, “state” should read --the state--.

COLUMN 4:
Line 24, “comer” should read --corner--.

COLUMN 9:
Line 10, “numbers” should read --numbers.--.
Line 28, “to” should be deleted.
Line 32, “to” should be deleted.
Line 37, “to” should be deleted.
Line 41, “to” should be deleted.
Line 47, “to” should be deleted.
Line 51, “to” should be deleted.

COLUMN 10:
Line 5, “to” should be deleted.
Line 8, “simple to” should read --simply--.

COLUMN 11:
Line 8, “prove” should read --proof--.

UNITED STATES PATENT AND TRADEMARK OFFICE

CERTIFICATE OF CORRECTION

PATENT NO. : 7,111,840 B2
APPLICATION NO. : 10/277035
DATED : September 26, 2006
INVENTOR(S) : Takayuki Miyamoto It is certified that error appears in the above-identified patent and that said Letters Patent is hereby corrected as shown below:

COLUMN 13:
Line 13, “comprises” should read --comprises:--.
Line 23, “that” should be deleted.
Line 30, “r” should be deleted.

Signed and Sealed this

Seventh Day of August, 2007

JON W. DUDAS
*Director of the United States Patent and Trademark Office*